US005573377A

United States Patent [19]

Bond et al.

[11] Patent Number: 5,573,377

[45] Date of Patent: Nov. 12, 1996

[54] ASSEMBLY OF A COMPOSITE BLADE ROOT AND A ROTOR

[75] Inventors: Nigel M. Bond, Loveland; Martin C. Hemsworth, Cincinnati, both of Ohio

[73] Assignee: General Electric Company, Cincinnati, Ohio

[21] Appl. No.: 426,205

[22] Filed: Apr. 21, 1995

[51] Int. Cl.[6] ..... F01D 5/14

[52] U.S. Cl. ..... 416/229 A; 416/219 R

[58] Field of Search ..... 416/219 R, 220 R, 416/229 A, 230

[56] References Cited

U.S. PATENT DOCUMENTS

| | | | |
|---|---|---|---|
| 3,679,324 | 7/1972 | Stargardter | 416/230 |
| 3,752,600 | 8/1973 | Walsh et al. | 416/219 |
| 3,756,745 | 9/1973 | Alver et al. | 416/219 |
| 3,883,267 | 5/1975 | Baudier et al. | 416/230 |
| 3,891,351 | 6/1975 | Norbut | 416/219 R |
| 4,040,770 | 8/1977 | Carlson | 416/230 |
| 4,169,694 | 10/1979 | Sanday | 416/219 R |
| 4,810,167 | 3/1989 | Spoltman et al. | 416/229 A |
| 4,980,241 | 12/1990 | Hoffmueller et al. | 428/607 |
| 5,160,243 | 11/1992 | Herzner et al. | 416/220 R |
| 5,240,375 | 8/1993 | Wayte | 416/219 R |
| 5,292,231 | 3/1994 | Lauzeille | 416/229 A |
| 5,340,280 | 8/1994 | Schilling | 416/219 R |
| 5,356,545 | 10/1994 | Wayte | 416/219 R |
| 5,375,978 | 12/1994 | Evans et al. | 416/230 |
| 5,403,153 | 4/1995 | Goetze | 416/229 A |

FOREIGN PATENT DOCUMENTS

| | | | |
|---|---|---|---|
| 0341455 | 11/1989 | European Pat. Off. | 416/219 R |

*Primary Examiner*—Edward K. Look
*Assistant Examiner*—Mark Sgantzos
*Attorney, Agent, or Firm*—Andrew C. Hess; David L. Narciso

[57] ABSTRACT

An assembly of a plurality of composite blades including blade roots carried by blade root receiving slots in the rotor wherein the slot has a slot wall with a radially outward portion which, when assembled, diverges from a spaced apart juxtaposed blade root pressure face radially outer surface in an amount which is a function of a predetermined amount of centrifugal loading on the blade during operation of the assembly, to allow at least a portion of the radially outer surface of the root pressure face to be in contact with the slot wall radially outward surface during operation.

4 Claims, 2 Drawing Sheets

ASSEMBLY OF A COMPOSITE BLADE ROOT AND A ROTOR

FIELD OF THE INVENTION

This invention relates to composite blades for fluid flow machines such as gas turbine engines, and, more particularly, to an improved blade root for improved distribution of loads to a support member such as a rotor.

BACKGROUND OF THE INVENTION

Certain conventional gas turbine engine fan blades and cooler operating compressor blades and dovetails or roots are manufactured from metal and are carried by a slot in a metal support member such as a rotor or a stationary casing. During operation, under high compressive loads and relative movement between the root and a wall of the slot, wear and fretting erosion have been observed, particularly with blade roots carried by a rotating member. Development of the gas turbine engine has resulted in replacement of certain metal blades with composite blades made of stacked or layed-up plies of a reinforced polymeric material, for example an epoxy matrix reinforced with a fiber structure such graphite, glass, boron, etc, as is well known in the art. Some of such blades are described in U.S. Pat. Nos. 3,752,600—Walsh et al, patented Aug. 14, 1973; 4,040,770—Carlson, patented Aug. 9, 1977; and 5,292,231—Lauzeille, patented Mar. 8, 1994. The disclosures of each of these patents are hereby incorporated herein by reference. Generally, in such known structures, it has been common practice to dispose metal outserts or metal shells between the blade root and the dovetail slot of the carrying member, in the splayed design conveniently used in such assemblies. The contact between the metal slot of the carrying member and the metal outsert or shell at the juncture between the blade and the slot has resulted in wear and fretting erosion at that interface.

SUMMARY OF THE INVENTION

The present invention, in one form, relates to a composite blade which includes a plurality of bonded composite plies including structural plies defining an airfoil layed-up or oriented to resist centrifugal loads, some of the plies extending into the blade root, the blade including root outer pads. The invention provides the improvement wherein the root outer pads comprise a plurality of substantially non-metallic, composite plies, rather than metal, bonded with the airfoil structural plies extending into the blade root. In a preferred form of the invention, the airfoil comprises a first plurality of bonded composite structural plies layed-up or arranged according to a first ply orientation system selected to resist centrifugal force loads, and the blade root comprises, in addition to the first plurality of structural plies extending therein to provide a blade core, a second plurality of composite plies, in one preferred form, layed-up on and concurrently with the core including the first plurality of plies, to provide a composite root outer pressure pad. In this form, the second plurality of plies is arranged according to a second ply orientation system, different from the first ply orientation system, and selected to transition compressive peaking loads from the blade root through the composite pressure pad to a support member or carrying structure such as a dovetail slot of a rotor. The second orientation system is selected to reduce shear stresses in the blade root as a result of replacing, in the second system, the orientation of a portion of the load carrying, structural plies with plies generally defining the outer pressure pad and oriented to provide chordwise stiffness which improves load transfer between the blade root and the support member.

The invention comprises a rotor assembly comprising a pluralty of the above described blades carded by a plurality of circumferentialy disposed blade root receiving slots having a slot wall shaped to receive the blade root, the blade root including a radially inner surface and the slot including a radially inward surface shaped to receive and carry the blade at least at a portion of the root inner surface. The slot wall includes a radially outward portion and the blade root includes a radially outer surface which diverge radially outwardly in juxtaposition from one another, when assembled, from a junction between the blade root inner and outer surfaces radially outwardly toward the airfoil. For example, the amount, such as an angle, of divergence can be selected as a function of the centrifugal loading on the blade during operation of the rotor assembly to allow at least a portion of the root at an outer area of a pressure face to be in contact with an outer portion of the slot wall during operation.

DESCRIPTION OF THE PREFERRED EMBODIMENTS

In the splayed root design of composite blades, for example as shown in patents incorporated above, a variety of internal wedge type inserts and external metal pads or metal shells have been included in the structure. These had been added in an attempt to transfer and diffuse loads and stresses from the blade airfoil through the blade base, such as a root or dovetail, to the blade carrying or support member, such as a rotor or a stationary support, which can be in the form of a ring, drum, casing, etc. However, in respect to the metal outsert pads or shells, it has been observed that, under high load conditions, such metal portions tend to separate from the blade base. In addition, wear and fretting erosion can occur at their juncture with metal carrying members such as a rotor. More frequent than desired repair of one or more of such components was required. The present invention obviates such problems by providing a composite blade with an integral, non-metallic composite root outer pad arrangement, rather than a metal pad or outsert, layed-up with plies of the same material as the structural plies, or composite plies of a different material. Preferably the plies have a different ply orientation, as mentioned above and described in more detail below.

One form of the present invention describes an improved base or root for such composite blade by providing a non-metallic composite root outer pressure pad layed-up with and integrally bonded with the blade root to form a unitary structure which, because it is bonded integrally with the blade core, will not separate from the core under high load conditions, resists wear and fretting erosion, and transfers loads efficiently from the airfoil and blade core through the root to the carrying structure. One form of the invention defines a combination of the blade and a slot in the carrying member wherein line contact between the blade root and a wall of the slot is relieved at an area radially outwardly of the end of the blade root to more efficiently distribute loads therebetween during operation. The invention will be more clearly understood by reference to the drawings.

Figure 1:
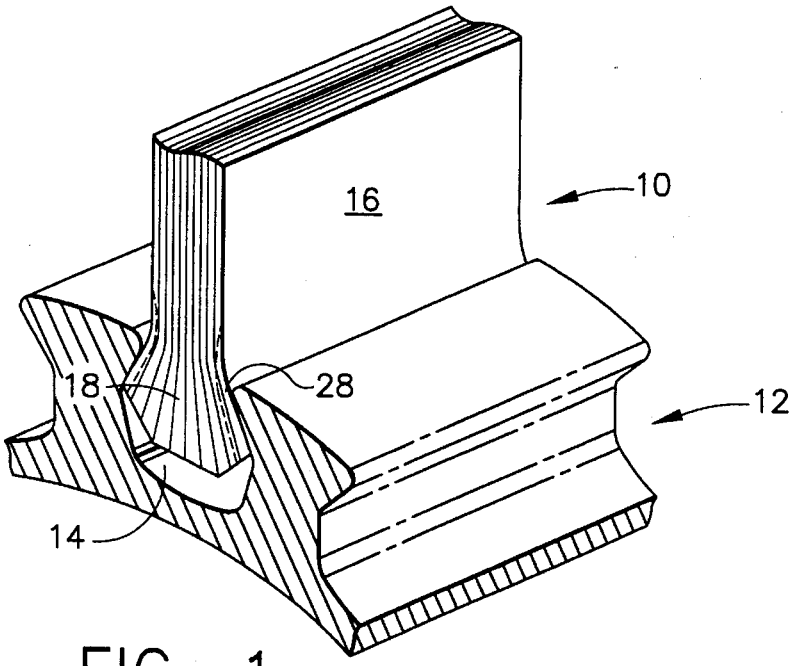
FIG. 1 is a fragmentary perspective partially sectional view of the composite blade of the present invention assembled in a dovetail slot of a gas turbine engine rotor.

FIG. 1 is a fragmentary perspective partially sectional view of a composite blade, shown generally at 10, carried by a supporting member for example a disk or rotor, shown generally at 12, through a dovetail slot 14. Blade 10, representative of a plurality of circumferentially disposed blades carded by a rotor in circumferentially disposed blade slots, comprises an airfoil 16 and a splayed base or root 18 through which the blade is carried by the rotor. The blade includes a plurality of layer-up or superimposed composite plies, a first plurality of structural and load carrying plies 20 in the airfoil and a second plurality of plies 22 in the base or root, which have been bonded together, such as by a process well known in the art, to form a pair of root outer pressure pads 28. The arrangement and relationship of the plies are shown more clearly in the other, more enlarged figures of the drawing.

Figure 2:
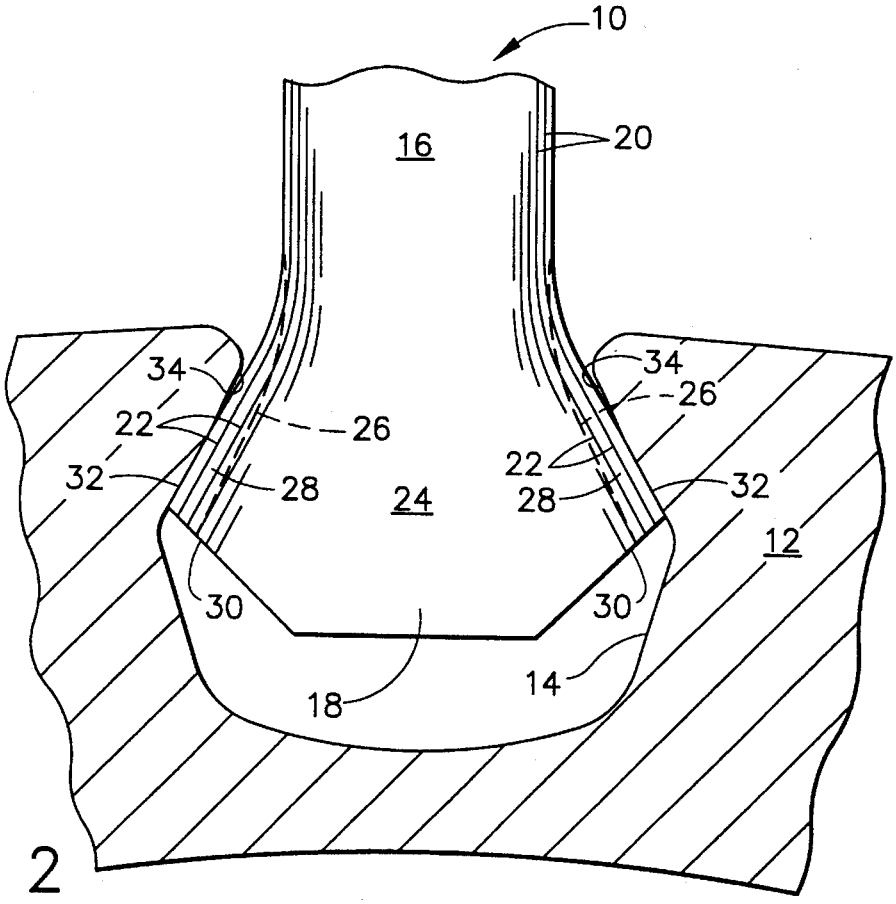
FIG. 2 is an enlarged fragmentary sectional view of a portion of the assembly of FIG. 1.

In FIG. 2, an enlarged fragmentary sectional view of the assembly of FIG. 1 is presented to show the position of and relationship between airfoil structural/load carrying plies 20 and the non-metallic composite root pad plies 22 layed-up and bonded with airfoil plies which extend into the root and form a root core 24. The bond area between plies 20 and 22 is shown by a broken line 26 because those portions of the root are bonded and intergral one with the other to define the blade core 24 and root outer pressure pad 28. In the arrangement shown in FIG. 1, the composite blade includes two non-metallic root outer pressure pads 28, one at each portion of the blade root intended to cooperate with and shaped to be carried by walls of dovetail slot 14. Pressure pad 28 includes a root end 30 extending along a radially inner portion of the root toward a root outer pressure face 32. Dovetail slot 14 includes a slot wall 34 which cooperates with root outer pressure face 32 to carry the blade root when assembled.

As was mentioned above, the first plurality of structural/load carrying airfoil plies have a first orientation selected to resist centrifugal force loads when the blade is in operation, for example in a rotor. The root outer pressure pad, in a preferred form of the invention, comprises a second plurality of nonmetallic composite plies which has a second orientation, different from the first orientation, and selected to transition compressive peaking loads from the blade root to the supporting member, such as a dovetail slot through the slot wall, and to reduce shear stresses in the blade root. In effect, such an arrangement or combination of ply orientations improves the fatigue life of the blade root by spreading the load from the airfoil more uniformly to the carrying member through the improved, integral blade root outer pressure pad. This can be accomplished, according to the present invention, by replacing some of the structural plies which extend into the blade root area from the airfoil with non-metallic composite plies oriented to transition compressive peaking loads and minimize shear, as mentioned above. For example, a typical structural/load carrying ply orientation selected to resist centrifugal force loads can be:

0/45/0/–45/0/45/ . . . (repeat)

According to the present invention, the second orientation for the second plurality of plies which form the root outer pressure pad replaces some of the load carrying plies, for example oriented in the "0" direction, with plies oriented to "soften" the arrangement for the above described purposes. One such pad ply orientation can be:

0/45/45/90/–45/–45/0/45/ . . . (repeat)

In the second orientation, the structural orientation . . . 45/0/–45/ . . . of the first orientation is replaced by the different orientation

. . . 45/45/90/–45/–45/ . . .

which transitions the loads and provides chordwise stiffness, as discussed above.

In a specific example, a plurality of composite plies of a carbon fiber reinforced unidirectional tape having a matrix of epoxy to provide a prepreg were first layed-up in the above structural first orientation to provide an airfoil shape, in a manner well known and widely used in the art. Some of such plies extended into the blade portion intended to become the blade base and formed a blade root core. On the blade root core were layed-up a second plurality of plies in the above second or pad orientation to form a prepreg of the root outer pad on the blade core. This arrangement was cured in a mold in the normal manner at about 350° F for about 5–6 hours to provide a unitary, integrally bonded composite blade preform in which the composite root outer pressure pads, which were layed-up with the airfoil plies, were bonded with the composite core. Then the preform was machined to the final desired shape, for example to provide the angular shaped blade base shown in FIG. 2. In this example, plies of the same prepreg material were used for both the structural airfoil plies and the root outer pressure pads. However, it should be understood that the materials of the first and second plurality of plies can be different one from the other. During evaluation of the present invention, prepregs including glass fibers, meshes, etc were evaluated in various prepreg combinations.

Through practice of the present invention, a blade root including root outer pads can be designed as a function of the stresses it is expected to be experienced during operation. Because the root outer pressure pads are integral with the blade root core and are of a composite material, separation of the pad from the core does not occur as with metal outserts or metal shells. Use of the present invention allows a blade root design to meet gas turbine engine life requirements without any major overhaul of the blade root region.

Figure 3:
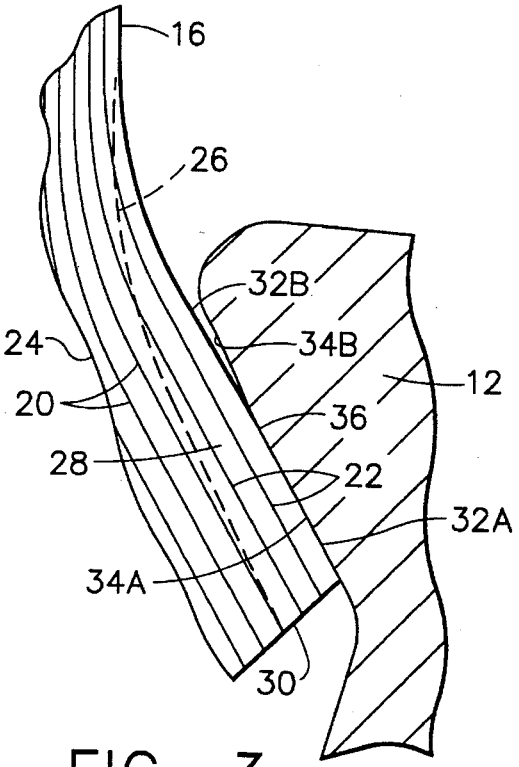
FIGS. 3, 4, and 5 are further enlarged diagrammatic fragmentary 5 views of different forms of the assembly of the blade root in the dovetail slot.
Figure 4:
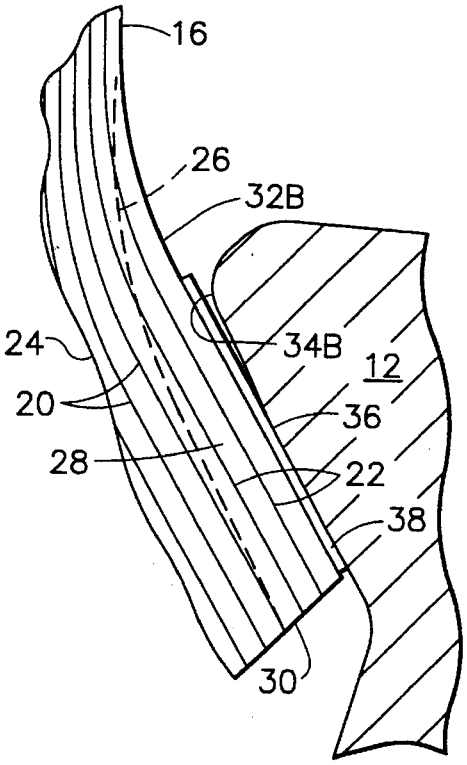
Figure 5:
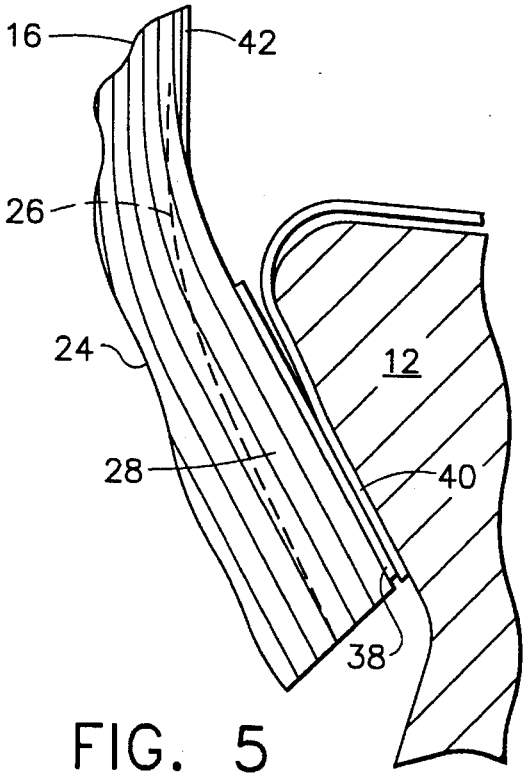

The further enlarged diagrammatic views of FIGS. 3, 4 and 5 show more details of additional embodiments of the present invention in connection with the assembly combination of the the blade root and dovetail slot. In the embodiment of FIG. 3, details of the "crowning" or relief between the blade outer pressure pad radially outer portion and the slot wall are shown. Root outer pressure face 32 of root pad 28 comprises a radially inner surface 32A, which cooperates in contact with dovetail slot wall radially inward portion 34A when assembled. Face 32 also includes a radially outer surface 32B, extending radially outwardly from a junction 36 between the pressure face inner and outer surfaces. Surface 32B is in spaced apart juxtaposition with dovetail slot wall radially outward portion 34B, generally diverging radially outwardly from junction 36, for example at a small angle such as in the range of about 1°–2°, beginning at the junction 36 of surfaces 32A and 32B. This embodiment of the present invention, sometimes referred to as "crowning" or being "crowned" in respect to the assembly of the blade and rotor, enables induced crush stresses, due to centrifugal force loading during operation of the rotor, to be dispersed in both the root pressure pad and the blade structural or airfoil plies along the full length of the pressure face 32: during operation the centrifugal force load tends to move surfaces 32B and 34B toward one another. It has been recognized that full length contact between the root outer pressure pad and the slot wall, at assembly, is not successful during operation. The crowning can be increased or decreased depending on or as a function of the centrifugal load condition being designed for. Further, the crowning does not necessarily have to be defined along a straight line: it can be several straight lines, curves, or a mixture of both. Either or both of the blade root or the slot wall can be crowned as long as the above described separation is provided. Without the separation of those surfaces at assembly and before operation, the dovetail will tend to load at the top of the pressure faces, resulting in a potential local failure of the dovetail slot wall. Therefore, one form of the present invention includes the above described, integral composite blade including a root outer pressure face assembled in combination with a dovetail slot wherein the slot wall and the the pressure face are "crowned" by shaping one or both of the cooperating surfaces as described above.

Another embodiment of the present invention is shown in the enlarged diagrammatic view of FIG. 4 which is an amplification of FIG. 3. In FIG. 4 there is included, on root outer pressure face 32, a low friction wear coat 38 to help reduce friction induced stresses in the blade root. Such a wear coat can be applied to and cured on the pressure face 32. Examples of such a coating material include self lubricating films or cloths such as a fabric weave of polytetrafluoroethylene (PTFE) fibers and glass type fibers, for example Teflon material fibers and Nomex material fibers. Some commercially available fabrics of that type and those used in the evaluation of the present invention include Fabroid X material and Fibriloid material. Also, a spray of Teflon material or other forms of PTFE material can be used. Although low friction wear coats have been used before on blade dovetails, the combination of a low friction coating with the above described "crowning", in one form of the present invention, will help prevent the blades from becoming locked in the rotor slot during deceleration of the rotor during operation. An additional benefit from use of the low friction coating in this combination is the ability of the blade root to slip at a predictable loading condition and provide damping for the blade during resonant crossings and potential blade instabilities, due to the relative motion between the blade base and the rotor slot wall. Through use of the low friction wear coat in this combination, the pressure faces can be defined at a relatively high angle, for example 60°. This is a high value when compared to conventional blades in a gas turbine engine fan which usually are at a maximum angle of 55°.

The enlarged diagrammatic view of FIG. 5, based on FIG. 4, shows additional embodiments of the present invention. In one form, the present invention includes, in combination with the low friction wear coat 38, a shim 40, between the low friction coat and slot wall 34, which provides a desired hardness and surface finish to obtain still more improved performance from the low friction wear coat material. This feature is particularly important where the slot wall is a titanium alloy in which desired wear properties are not always achievable. The shim, which extends the life of the wear coat and prevents wear from occuring to the slot wall, is positioned, as shown in FIG. 5, between the wear coat and the slot wall and is both replaceable and removable from the rotor dovetail. The shim can be made of a single material such as steel, titanium or a titanium alloy or it can be a single material having a coating such as copper or a copper alloy on one side. In another form, the shim can be a bimetallic material such as a strip or sheet of an iron base alloy, for example steel, secured with a strip or sheet of a softer material, for example copper or a copper alloy. In the example of a bimetallic shim having a relatively hard iron base alloy on one side and the relatively soft copper or copper ahoy on the other side, the soft side is disposed opposite the slot wall to help prevent any relative motion between the slot wall and the shim, avoiding fretting or wear of the slot wall. According to the present invention, the shim in the forms described above includes material properties, and surface finish, on the side that opposes the low friction coat, that improves performance of such a coating. The other side of the shim that opposes the slot wall and the rotor can be of a different material, which is sacrificial, so that the shim does not cause wear or fretting of the slot pressure faces. Use of a relatively soft material on the side of the shim that opposes such slot wall helps to prevent relative motion between the wall and the shim, preventing fretting or wear of the slot wall. Also, it forces substantially all motion to take place between the low friction wear coat and the shim, where the coefficient of friction is known, and the optimization of the blade root stresses can be fully utilized.

Another feature associated with the blade of the present invention, is the use of sacrificial machining plies 42 in FIG. 5. Machining plies 42 are layed-up and cured with and upon the airfoil and pressure pad plies, generally over the junction or overlap area of those ply groups, during manufacture of the blade preform which subsequently is machined to final shape. The number of machining plies required is based upon the variations expected during curing of the blade root, and profile, and thickness tolerances, of the final machined blade root. The machining plies are sacrificial so none of the structural or pressure pad plies are cut during machining of the blade root. Use of the machining plies provides the ability to conduct final machining of the specially oriented pressure pad plies which have been configured to optimize blade stresses as described above, in an area of overlap between the airfoil plies and the root pad plies. Weakening of the pad plies could result in premature failure of the blade root.

The present invention has been described in connection with various embodiments, examples and combinations. However, it will be understood by those skilled in the arts involved that this invention is capable of a variety of modifications, variations and amplification without departing from its scope as defined in the appended claims.

We claim:

1. In combination, a rotor assembly comprising a plurality of composite blades carried by a rotor as a support member, each composite blade including a plurality of bonded composite plies comprising an airfoil and a blade root shaped to be carried by the rotor, the blade root having a composite root outer pressure pad disposed on the root and carried by the rotor, the composite root outer pressure pad comprising a plurality of non-metallic composite piles bonded together and with the blade root, the improved combination wherein:

the rotor includes a plurality of circumferentially disposed blade root receiving slots having a slot wall at least a portion of which is shaped to receive a blade root, the slot wall including a radially inward portion and a radially outward portion and shaped to receive and carry at least a portion of a root outer pressure face of the composite root pressure pad;

the blade including a root outer pressure face on the composite root outer pressure pad, the pressure face having a radially inner surface, extending from a root end, and a radially outer surface, extending from a junction with the inner surface toward the blade airfoil, the inner surface being in contact with and carried by the slot wall radially inward portion to carry the blade root when assembled with the rotor; and, the root pressure face radially outer surface and the slot wall radially outward portion, when assembled, being in diverging spaced apart juxtaposition beginning at the junction between the root pressure face inner and outer surfaces and generally diverging radially outwardly therefrom in a diverging amount which is a function of a predetermined amount of centrifugal loading on the blade during operation of the rotor assembly, to allow at least a portion of the radially outer surface of the root outer pressure face to be in contact with the slot wall radially outward surface during operation.

2. The assembly of claim 1 in which the diverging amount is at a small angle in the range of about 1°–2°.

3. The assembly of claim 1 in which a low friction wear coat is bonded on the root outer pressure face between the pressure face and the slot wall.

4. The assembly of claim 3 which includes, in addition, a shim carried by the slot wall and disposed between the low friction wear coat and the slot wall.

* * * * *